US006495958B1

(12) United States Patent
Moon

(10) Patent No.: US 6,495,958 B1
(45) Date of Patent: Dec. 17, 2002

(54) PLASMA DISPLAY PANEL HAVING ELECTRODES FORMED OF CONDUCTIVE WIRES

(75) Inventor: Cheol-hee Moon, Chunan (KR)

(73) Assignee: Samsung SDI Co., Ltd., Kyungki-do (KR)

( * ) Notice: Subject to any disclaimer, the term of this patent is extended or adjusted under 35 U.S.C. 154(b) by 0 days.

(21) Appl. No.: 09/333,946

(22) Filed: Jun. 16, 1999

(30) Foreign Application Priority Data

Dec. 10, 1998 (KR) ..... 98-54196

(51) Int. Cl.[7] ..... H01J 17/49

(52) U.S. Cl. ..... 313/584; 313/491; 313/493; 313/586; 313/587

(58) Field of Search ..... 313/584, 491, 313/493, 586, 587

(56) References Cited

U.S. PATENT DOCUMENTS 4,517,492 A * 5/1985 Byrum, Jr. et al. ..... 313/587

5,675,216 A * 10/1997 Kumar et al. ..... 313/495

FOREIGN PATENT DOCUMENTS

| | | |
|---|---|---|
| JP | 7-169403 | 7/1995 |
| KR | 95-24234 | 8/1995 |
| KR | 97-17832 | 4/1997 |

* cited by examiner

*Primary Examiner*—Vip Patel
*Assistant Examiner*—Kevin Quarterman
(74) *Attorney, Agent, or Firm*—Lowe Hauptman Gilman & Berner, LLP

(57) ABSTRACT

A plasma display panel including upper and lower substrates which are opposite to each other, a pair of upper electrodes formed to be spaced apart from each other on the lower surface of the upper substrate, a first dielectric layer coated on the lower surface of the upper substrate to bury the upper electrodes, partition walls installed to be spaced apart from each other on the lower substrate, for defining discharge spaces, lower electrodes formed of conductive wires on the upper substrate in the discharge spaces so as to be orthogonal to the upper electrodes, and a phosphor layer coated in the discharge spaces.

15 Claims, 5 Drawing Sheets

PLASMA DISPLAY PANEL HAVING ELECTRODES FORMED OF CONDUCTIVE WIRES

BACKGROUND OF THE INVENTION

1. Field of the Invention

The present invention relates to a plasma display panel, and more particularly, to a plasma display panel adopting a wire-type electrode.

2. Description of the Related Art

A plasma display panel includes two substrates on which a plurality of electrodes are formed, and gas filled between the two substrates. A discharge voltage is applied to the electrodes to discharge the gas. A phosphor material emits light by virtue of ultraviolet rays generated from the discharged gas, thereby forming a picture.

FIG. 1 shows an example of such a plasma display panel. Referring to FIG. 1, an upper electrode 13 is formed in strips on the bottom surface of an upper substrate 11, and buried by a first dielectric layer 14. A protection layer 15 such as a magnesium oxide (MgO) layer can be formed on the lower surface of the first dielectric layer 14.

A lower electrode 16 is formed in strips on a lower substrate 12 facing the upper substrate 11, so as to be orthogonal to the upper electrode 13. The lower electrode 16 is buried in a second dielectric layer 17. Partition walls 18 defining a discharge space are formed to be spaced apart from each other on the second dielectric layer 17. Red, green and blue phosphor layers 19 are coated between the partition walls 18.

In manufacturing the conventional plasma display panel, the electrodes 13 and 16 on the upper and lower substrates 11 and 12 are manufactured by a printing method of forming a pattern using a conductive paste, a photolithographic method using a photosensitive paste, a sputtering method, or a deposition method.

The partition walls 18 are also formed by placing a screen with a predetermined pattern on the lower substrate 12 and printing and curing a partition wall material. The phosphor layers 19 are formed between the partition walls 18 by the printing method, a dispensing method, or the photolithographic method.

However, these manufacturing methods require many unit processes and are very complicated. In particular, the printing method widely used in manufacturing partition walls provides repetition of an identical process, to increase the possibility of errors between processes. Therefore, the failure rate is high, and the reliability on the quality of products is thus degraded.

SUMMARY OF THE INVENTION

To solve the above problems, it is an objective of the present invention to provide a plasma display panel capable of simplifying the manufacturing process thereof and improving the reliability of the product quality by adopting a wire electrode or partition walls.

According to an aspect of the present invention to achieve the above objective, there is provided a plasma display panel comprising: upper and lower substrates which are opposite to each other; a pair of upper electrodes formed to be spaced apart from each other on the lower surface of the upper substrate; a first dielectric layer coated on the lower surface of the upper substrate to bury the upper electrodes; partition walls installed to be spaced apart from each other on the lower substrate, for defining discharge spaces; lower electrodes formed of conductive wires on the upper substrate in the discharge spaces so as to be orthogonal to the upper electrodes; and a phosphor layer coated in the discharge spaces.

The plasma, display panel further comprises: a second dielectric layer coated on the outer circumferential surface of the lower electrode; and a phosphor layer coated on the surface of the second dielectric layer.

According to another aspect of the present invention to achieve the above objective, there is provided a plasma display panel comprising: upper and lower substrates which are opposite to each other; a pair of upper electrodes formed to be spaced apart from each other on the lower surface of the upper substrate; a first dielectric layer coated on the lower surface of the upper substrate to bury the upper electrodes; partition walls formed of insulative wires and installed to be spaced apart from each other on the lower substrate, for defining discharge spaces; lower electrodes installed on the upper substrate in the discharge spaces so as to be orthogonal to the upper electrodes; and a phosphor layer coated in the discharge spaces.

According to still another aspect of the present invention to achieve the above objective, there is provided a plasma display panel comprising: upper and lower substrates which are opposite to each other; a pair of upper electrodes formed to be spaced apart from each other on the lower surface of the upper substrate; a first dielectric layer coated on the lower surface of the upper substrate to bury the upper electrodes; lower electrodes formed of conductive wires on the upper substrate so as to be orthogonal to the upper electrodes; a second dielectric layer coated on the lower substrate to bury the lower electrodes; partition walls formed of insulative wires and installed to be spaced apart predetermined distances from each other on the dielectric layer, for defining discharge spaces; and a phosphor layer coated in the discharge spaces.

BRIEF DESCRIPTION OF THE DRAWINGS

The above objective and advantage of the present invention will become more apparent by describing in detail preferred embodiments thereof with reference to the attached drawings in which.

DESCRIPTION OF THE PREFERRED EMBODIMENTS

Figure 2:
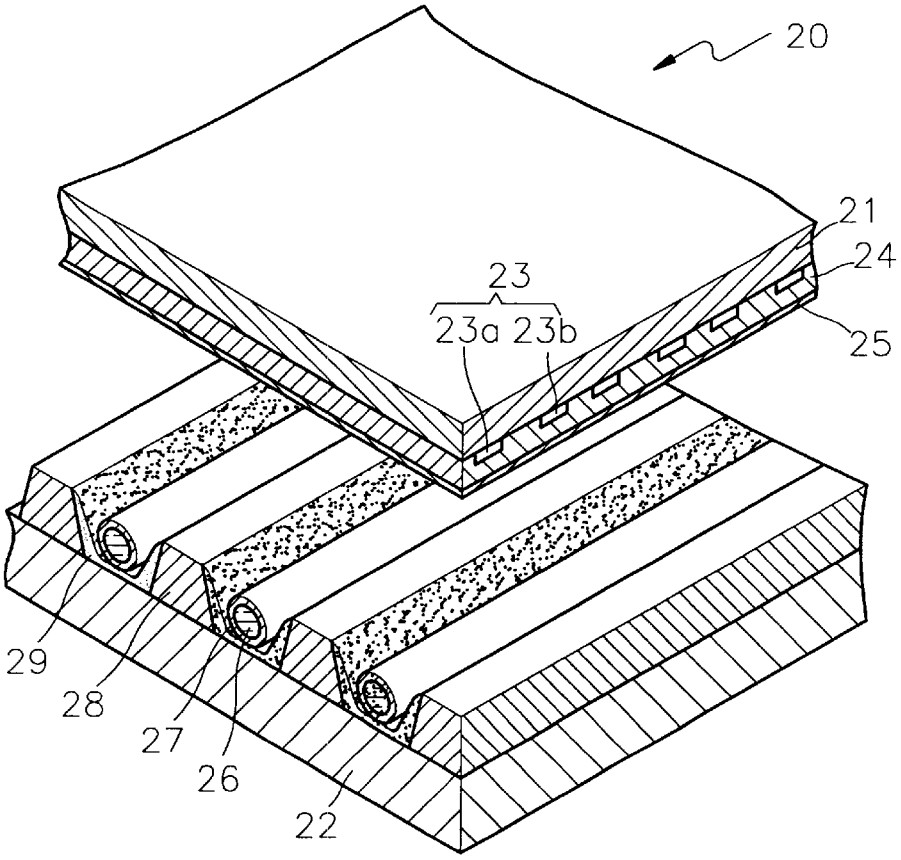
FIG. 2 is an exploded perspective view of a plasma display panel according to an embodiment of the present invention.

FIG. 2 is an exploded view of a plasma display panel 20 according to the present invention. The plasma display panel 20 includes transparent upper and lower substrates 21 and 22 spaced apart from each other. Upper electrodes 23, comprised of alternating strips of common electrodes 23*a* and scanning electrodes 23*b,* are formed on the bottom surface of the upper substrate 21. The upper electrodes 23 are buried in a first dielectric layer 24 coated on the lower surface of the upper substrate 21. A protection layer 25 such as a magnesium oxide layer can be coated on the bottom surface of the first dielectric layer 24, to achieve a reduced driving voltage and improvements in the driving efficiency using a second electron emission.

Partition walls 28 are formed to be spaced apart from each other on the upper surface of the lower substrate 22, so as to be orthogonal to the upper electrodes 23. The partition walls 28 form discharge spaces between the upper and lower substrates 21 and 22, and prevent cross-talk between discharge cells. Red, green, and blue phosphor layers 29 are coated in the discharge spaces between the partition walls 28.

Lower electrodes 26, being address electrodes, are installed between the partition walls 28 and thus orthogonal to the upper electrodes 23. The lower electrodes 26 are conductive wires, preferably formed of a metal such as aluminum, copper, gold, or platinum.

Figure 1:
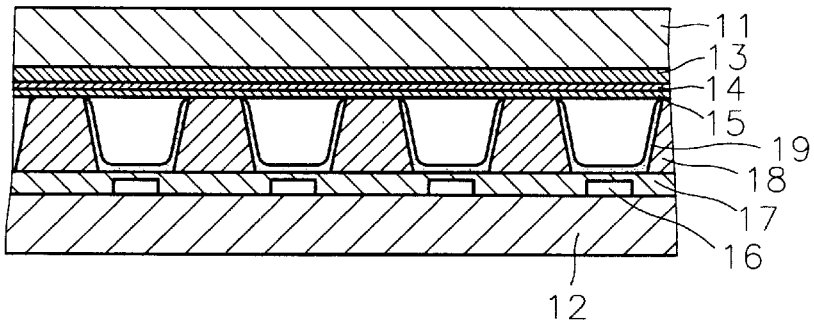
FIG. 1 (PRIOR ART)
FIG. 1 is a cross-sectional view of a conventional plasma display panel.

The conventional lower electrodes 16 (see FIG. 1), formed by the printing method or the photolithographic method, must have a width of at least 50 to 100 $\mu$m to obtain a desired conductivity. However, the lower electrode 26 according to the present invention can have a diameter of about 5 to 10 $\mu$m since it is formed of a conductive metal wire. Thus, the aperture ratio can be increased.

A second dielectric layer 27 is coated on the outer circumferential surfaces of the lower electrode 26. The second dielectric layer 27 can be formed by sputtering or deposition. Alternatively, the lower electrode 26 can be coated with the second dielectric layer 27 by being passed through a special coating device (not shown).

Preferably, a continuous process line can be formed, including a process for coating the wire with the second dielectric layer 27, a process for drying and curing the second coated dielectric layer 27, etc.

In the operation of a display panel having such a configuration, when a voltage is applied between the scanning electrode 23*b* and the lower electrode 26, preliminary discharge occurs and a wall charge is accumulated in the discharge space. In this state, a voltage is applied between the common electrode 23*a* and the scanning electrode 23*b* so that a glow discharge occurs to form a plasma. Ultraviolet rays are emitted from the plasma, and excite the phosphor layers 29, thereby displaying an image.

FIGS. 3 through 10 illustrate various other embodiments of the present invention. Here, the same reference numerals as those of FIG. 2 denote the same elements.

Figure 3:
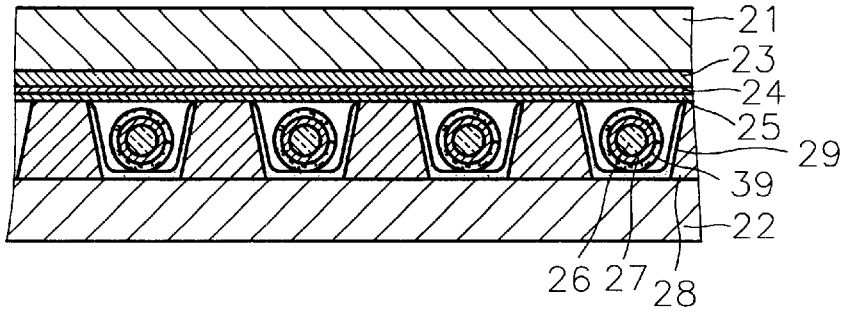
FIGS. 3 through 5 are cross-sectional views of a plasma display panel according to another embodiments of the present invention.

Referring to the second embodiment of the present invention shown in FIG. 3, a phosphor layer 39 is coated on the surface of the second dielectric layer 27 coated on the outer circumferential surface of the lower electrode 26 interposed between partition walls 28. Thus, the phosphor area is enlarged, thus increasing the luminance of radiation.

Figure 4:
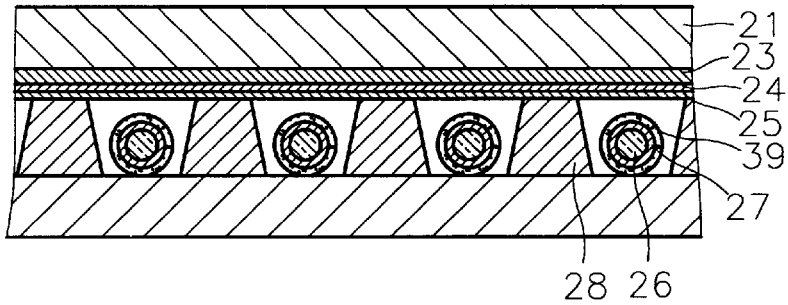

Alternatively, as in the third embodiment of the present invention shown in FIG. 4, a phosphor layer is not coated on the side surface of the partition wall 28, and the phosphor layer 39 is coated only on the surface of the second dielectric layer 27.

Figure 5:
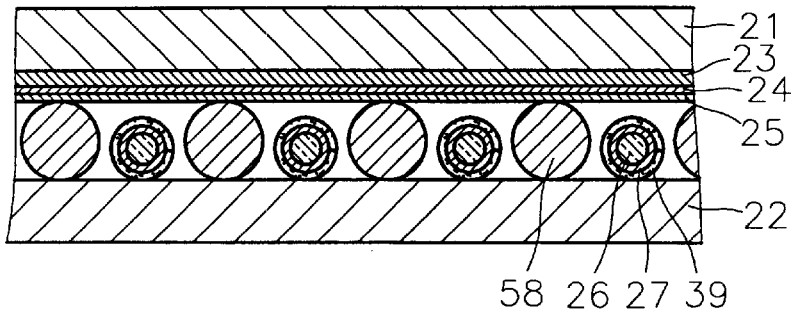

FIG. 5 shows a plasma display panel according to a fourth embodiment of the present invention.

According to this embodiment, partition walls 58, interposed between the upper and lower substrates 21 and 22 for defining discharge spaces together with the upper and lower substrates, are also formed like wires, similar to the address electrodes 26.

The wire-like partition walls 58 are made of a ceramic material such as silicon carbide (SiC) to provide insulation. Preferably, a black or white paste is coated on the outer circumferential surface of the wire-like partition walls 58 to improve contrast or reflectivity.

Figure 6:
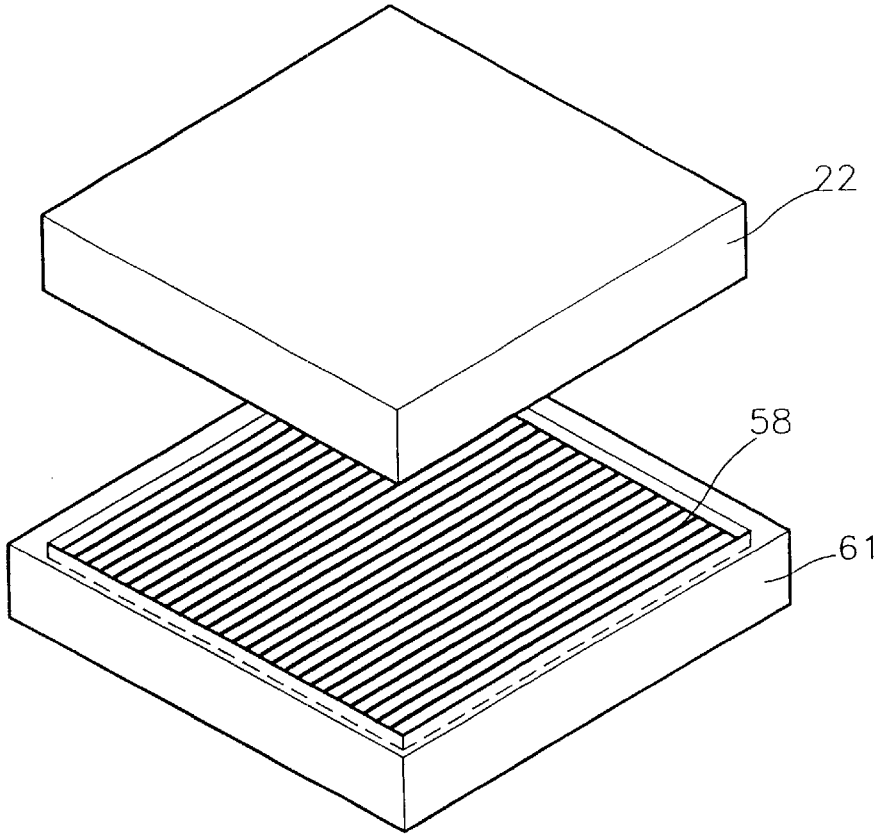
FIGS. 6 and 7 are perspective views illustrating a process for manufacturing the plasma display panel shown in FIG. 5.

A separate frame 61 shown in FIG. 6 is required to install the wire-like partition walls 58 on the lower substrate 22. A plurality of grooves are formed on the frame 61, being spaced predetermined distances. The wire-like partition walls 58 are put in these grooves.

Figure 7:
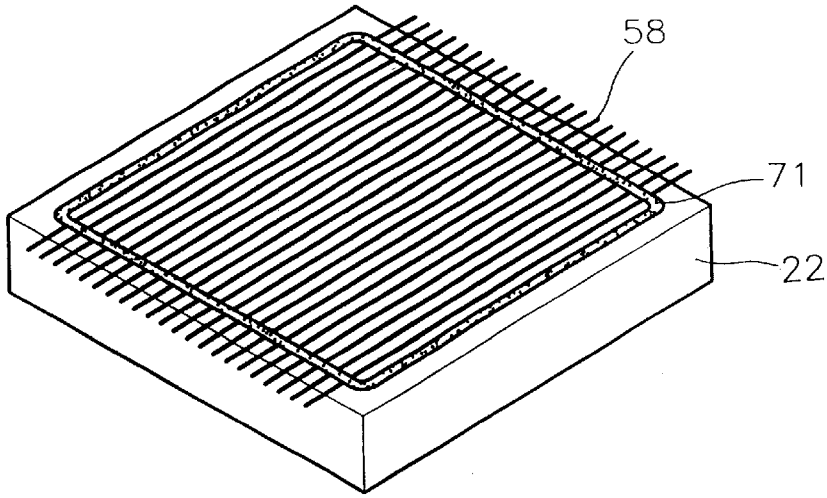

Next, the lower substrate 22 is disposed on the frame 61, and the lower substrate 22 and the frame 61 adhere closely to each other. Here, in order to fix the wire-like partition walls 58, a glass frit 71 comprised of glass powder containing a large amount of lead (Pb) is coated along the edge of the lower substrate 52 as shown in FIG. 7. The wire partition walls 58 are fixed by drying and curing the glass frit 71.

Figure 8:
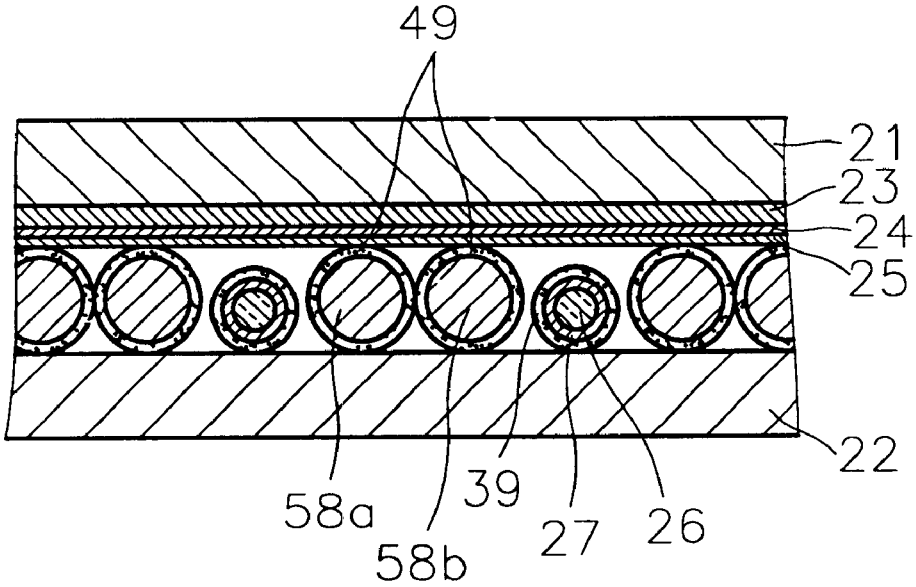
FIGS. 8 through 10 are cross-sectional views of a plasma display panel according to still another embodiments of the present invention.

At least two wire partition walls 58*a* and 58*b* can be included as shown in FIG. 8, to prevent cross-talk between adjacent discharge cells and color blotting. That is, at least two wire partition walls 58*a* and 58*b* are juxtaposed adjacent to each other between the upper and lower substrates 21 and 22.

Preferably, a phosphor layer 49 is coated on the surface of each of the wire partition walls 58*a* and 58*b,* to increase the light emitting area of a phosphor material.

Figure 9:
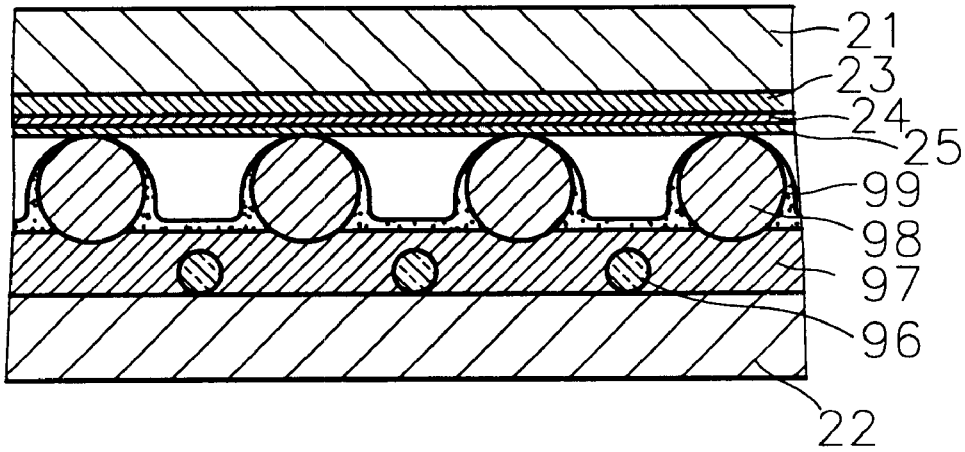

FIG. 9 is a cross-sectional view of a plasma display panel according to still another embodiment of the present invention. According to this embodiment, lower electrodes 96 formed of conductive wires are installed on the lower substrate 22, so as to be orthogonal to the upper electrodes 23. The lower electrodes 96 are buried by a dielectric layer 97. Partition walls 98 formed of insulative wires are installed to be spaced predetermined distances apart from each other on the dielectric layer 97. Red, green, and blue phosphor layers 99 are coated between the wire partition walls 98.

Figure 10:
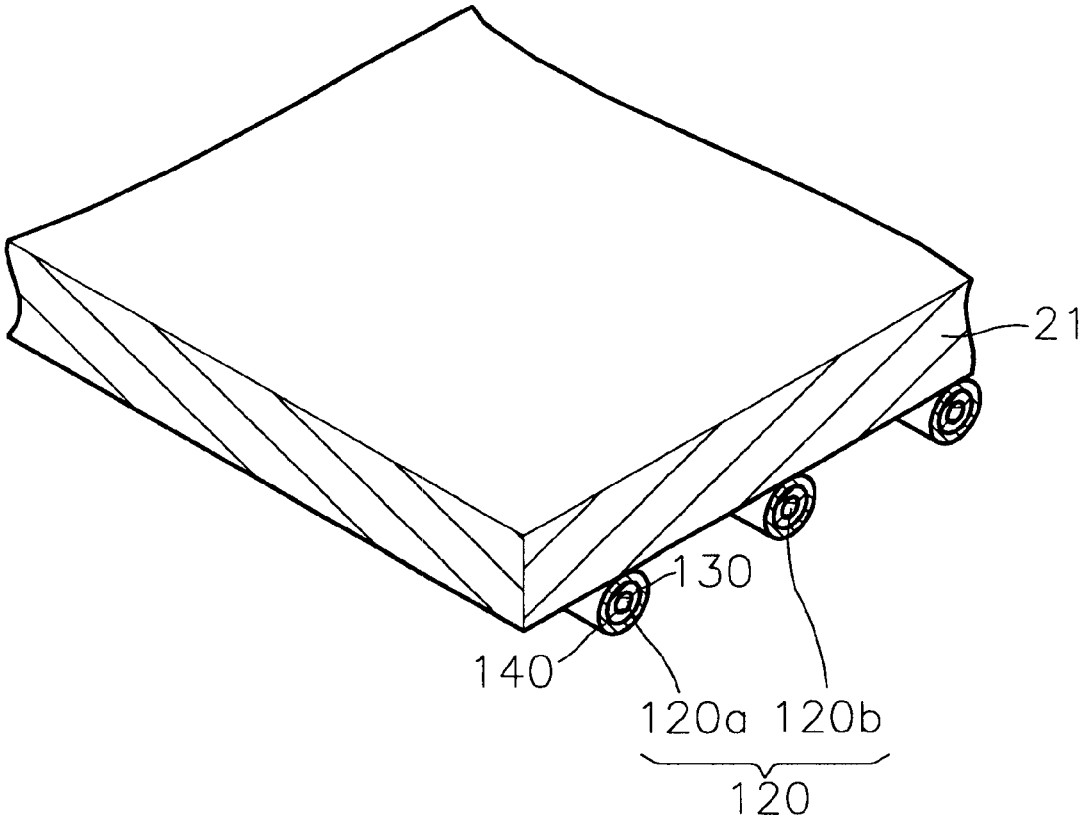

Referring to FIG. 10 showing yet another embodiment of the present invention, upper electrodes 120 each including a common electrode 120*a* and a scanning electrode 120*b* are formed of wires on the lower surface of the upper substrate 21. The upper electrodes 120 are formed of conductive metal wires such as aluminum, copper, gold, or platinum, similar to the aforementioned embodiments.

A dielectric layer 130 is coated on the outer circumferential surface of the upper electrode 120. The dielectric layer 130 is coated with a protection layer 140 to protect the dielectric layer 130 and achieve a reduced driving voltage using a second electron emission and improvements in the driving efficiency.

In the plasma display panel according to the present invention, the partition walls or electrodes are formed of wires and installed, so that the plasma display panel is very simply manufactured compared to when using conventional methods such as printing, deposition, and photolithography. Also, the failure rate is reduced by mechanically installing the wires on the lower substrate or between the partition walls, thus improving the reliability of the product quality. Furthermore, display panels having various modified structures can be simply manufactured by coating a phosphor material on the surfaces of the wires, so that the present invention is widely applicable.

The present invention is described referring to the embodiments shown in the drawings, but the embodiments are just examples. It will be understood by those skilled in the art that various modifications and other embodiments may be effected. Thus, the true technical protection scope of the present invention must be determined by the attached claims.

What is claimed is:

1. A plasma display panel, comprising:

upper and lower substrates opposite to each other;

a plurality of upper electrodes formed, while spaced from each other, on the upper substrate;

an upper dielectric layer coated on the upper substrate to bury the upper electrodes;

a plurality of partition walls formed of insulative wires and installed, while spaced from each other, on the lower substrate and between the upper and lower substrates for defining a plurality of discharge spaces therebetween;

a plurality of lower electrodes installed on the lower substrate in the discharge spaces so as to be transverse to the upper electrodes; and a phosphor material provided in the discharge spaces, the phosphor material includes a plurality of phosphor layers each coated on an entire outer circumferential surface of one of said insulative wires.

2. A plasma display panel, comprising:

upper and lower substrates spaced from each other;

a plurality of upper electrodes formed, while spaced from each other, on the upper substrate;

a plurality of partition walls installed, while spaced from each other, between the upper and lower substrates for defining a plurality of discharge spaces therebetween;

a plurality of lower electrodes formed of conductive wires in the discharge spaces and extending transverse to the upper electrodes;

a phosphor material provided in each of the discharge spaces; and a plurality of discrete dielectric layers each coated on an outer circumferential surface of one of the lower electrodes, the dielectric layers being separate from each other.

3. A plasma display panel, comprising:

upper and lower substrates opposite to each other;

a plurality of upper electrodes formed of conductive wires, while spaced from each other, on the upper substrate;

an upper dielectric layer coated on an entire outer circumferential surface of each of the upper electrodes;

a plurality of partition walls installed, while spaced at a predetermined distance from each other, on the lower substrate for defining a plurality of discharge spaces therebetween;

a plurality of lower electrodes installed on the lower substrate so as to be transverse to the upper electrodes; and a phosphor material provided in each of the discharge spaces.

4. The plasma display panel as claimed in claim 3, further comprising a protection layer coated on an entire outer circumferential surface of the upper dielectric layer.

5. A plasma display panel, comprising:

upper and lower substrates spaced from each other;

a plurality of upper electrodes formed, while spaced from each other, on the upper substrate;

a plurality of partition walls installed, while spaced from each other, between the upper and lower substrates for defining a plurality of discharge spaces therebetween;

a plurality of lower electrodes formed of conductive wires in the discharge spaces and extending transverse to the upper electrodes;

a phosphor material provided in each of the discharge spaces; and a dielectric layer coated on an entire outer circumferential surface of each of the conductive wires.

6. The plasma display panel as claimed in claim 5, wherein the conductive wires have a rounded cross-section.

7. The plasma display panel as claimed in claim 5, wherein the lower electrodes are orthogonal to the upper electrodes.

8. The plasma display panel as claimed in claim 5, wherein the conductive wires have a diameter of from about 5 to about 10 mm.

9. The plasma display panel as claimed in claim 5, wherein the phosphor material includes a phosphor layer coated on an entire outer circumferential surface of the dielectric layer.

10. The plasma display panel as claimed in claim 9, wherein the partition walls are formed of insulative wires.

11. The plasma display panel as claimed in claim 5, wherein the upper electrodes are formed on a lower surface of the upper substrate.

12. The plasma display panel as claimed in claim 11, further comprising another dielectric layer coated on the lower surface of the upper substrate to bury the upper electrodes.

13. The plasma display panel as claimed in claim 5, wherein the partition walls are formed of insulative wires.

14. The plasma display panel as claimed in claim 13, wherein each of the partition walls includes at least two said insulative wires adjacent to each other.

15. The plasma display panel as claimed in claim 13, wherein the phosphor material includes a phosphor layer coated on an entire outer circumferential surface of each of the insulative wires.

* * * * *